US006008720A

United States Patent [19]

Hongu et al.

[11] Patent Number: 6,008,720

[45] Date of Patent: Dec. 28, 1999

[54] PORTABLE TIMER ALARM DEVICE WITH EAR ATTACHMENT

[75] Inventors: Kanji Hongu, Yokohama; Yoshiaki Sakamoto, Tokyo, both of Japan

[73] Assignee: Honda Tsushin Kogyo Co., Ltd., Japan

[21] Appl. No.: 08/692,078

[22] Filed: Aug. 7, 1996

[30] Foreign Application Priority Data

Aug. 7, 1995 [JP] Japan ..... 7-230622
Apr. 15, 1996 [JP] Japan ..... 8-126204

[51] Int. Cl.[6] ..... G08B 1/00

[52] U.S. Cl. ..... 340/309.15; 340/407.1; 368/63; 368/156

[58] Field of Search ..... 340/309.15, 692, 340/384.7, 384.71, 407.1; 381/68.5, 68.6, 68.7; 368/63, 156

[56] References Cited

U.S. PATENT DOCUMENTS

| | | | |
|---|---|---|---|
| 3,938,128 | 2/1976 | Pidsosny et al. | 340/309.15 |
| 3,998,045 | 12/1976 | Lester | 368/63 |
| 4,319,319 | 3/1982 | Wygant | 340/309.15 |
| 4,376,993 | 3/1983 | Freeman | 368/69 |
| 4,444,515 | 4/1984 | Clark | 368/156 |
| 4,777,474 | 10/1988 | Clayton | 340/407.1 |
| 4,821,247 | 4/1989 | Grooms | 368/63 |
| 5,165,107 | 11/1992 | Hand et al. | 340/309.15 |

FOREIGN PATENT DOCUMENTS

| | | |
|---|---|---|
| 2480958 | 10/1981 | France . |
| 4116533C1 | 7/1992 | Germany . |
| 63-235886 | 9/1988 | Japan . |
| 2-293689 | 12/1990 | Japan . |
| 2009976 | 6/1979 | United Kingdom . |

*Primary Examiner*—Jeffery A. Hofsass
*Assistant Examiner*—John Tweel, Jr.
*Attorney, Agent, or Firm*—Rosi & Associates

[57] ABSTRACT

A timer alarm device is supported on an ear as an earring by pinching an earlobe of the ear with an arm and a clip. Spring force to pinch the earlobe is produced by permitting a spring provided on the clip to run on a corner of a flat part. A timer circuit, a piezoelectric buzzer, and a battery cell, etc., are accomodated on a head part provided on the upper part of the arm. Since the piezoelectric buzzer for outputting an alarm sound is located in the vicinity of an earhole, a user can hear a greater sound even with a smaller sound volume and hence attention of the user can be securely called. Since functions and component parts are limited to eliminate the need of setting and confirmation that rely upon eyes, even a visually handicapped user can conveniently use the device.

17 Claims, 5 Drawing Sheets

PORTABLE TIMER ALARM DEVICE WITH EAR ATTACHMENT

BACKGROUND OF THE INVENTION

1. Field of the Invention

The present invention relates to a miniature timer alarm device for informing a user of the lapse of arbitrarily set time with an audio alarm sound.

2. Description of the Prior Art

An alarm clock and a timer-equipped radio set are capable of informing a user of arbitrary set time or the lapse of the arbitrary set time with use of an intermittent sound from a piezoelectric buzzer, a sound message, a regenerated sound of broadcasting, and so on. For users however, it is difficult to wear it on usually.

In this respect, there is known an alarm-equipped wristwatch which is worn on a user's hand every day and has a timer function of informing the user of the lapse of arbitrarily set time using a piezoelectric buzzer.

When a user gets off a train at a station in the course of the line, for example, provided the user sets the alarm-equipped wristwatch with a little shorter time than the necessary time up to the station, the user is prevented from being carelessly carried beyond the station, because a piezoelectric buzzer rings on this side of the station.

Further, provided such an alarm-equipped wristwatch is used when a user intends to make a telephone call after 30 minutes or when a meeting is held within the limits of 1 hour, for example, even if the user concentrates upon another work or meeting, the wristwatch correctly informs the user of the lapse of set time with an intermittent sound of a piezoelectric buzzer and recalls the user to things which he must do.

The alarm-equipped wristwatch however has a drawback that the volume of an alarm is small so that there is the possibility of the alarm sound being missed to be heard. Further, an excessive increase of the volume of a sound causes severe exhaustion of an electric battery cell and an alarm sound draws attentions of other unrelated persons around the user to bring about a trouble.

Furthermore, the alarm-equipped wristwatch usually has a wristwatch function as a first main function and an alarm clock function of informing a user of set time as a second fucntion, so that the timer function is only one non-important attached function.

Accordingly, a set operation of time and a start operation as a timer are complicated or unkind, and hence practical use of a timer function itself is sometimes lower. Thus, even if a timer function is incorporated in the alarm-equipped wristwatch, actual use thereof is hesitated or troublesome or anxious in the setting and operation thereof to result in substantially non-applicability thereof.

SUMMARY OF THE INVENTION

To solve the problems of the prior art, it is an object of the present invention to provide an easily useable timer alarm device in which even though the volume of an alarm output with a sound is small, attention of a user can be securely called and even a user having a defect in his eye can utilize it without difficulty.

In accordance with the first aspect of the present invention, a timer alarm device comprises a timer circuit for detecting the lapse of set time to output an alarm driving signal, alarm output means driven by said alarm driving signal to output an audio alarm, a battery cell for supplying a power supply to said timer circuit and said alarm output means, and a casing structure for housing said timer circuit, said alarm output means, and said battery cell wherein said timer alarm device further comprises a mounting mechanism in which said casing structure and the weight of the whole device are defined within a range where they can be supported with an ear, and said casing structure is supported with an ear, and said alarm output means is positioned in the vicinity of an ear hole. Hereby, the whole of the timer alarm device is supported on the ear and an audio alarm sound is outputted in the vicinity of the ear hole. It is therefore possible to call a greater attention of a user with even a smaller output than in the cases where the timer alarm device is mounted on an arm or put in a pocket of a shirt. There is accordingly eliminated an anxiety of a user of missing to hear the alarm even in a subway, a jet coaster, and in violent wind and rain.

The alarm may include an intermittent sound and a continuous sound from a piezoelectric buzzer and from other electronic buzzers, and composite tone messages from a miniature speaker, and the like.

With the construction, the timer alarm device has the lower possibility of removal thereof during the use compared with the case where it is mounted on an arm, and has the lower possibility of its being missed during the use compared with the cases where it is put in a pocket or in a bag. There is further eliminated the need of an obstructive cable unlike the case where an earphone led from a body is used.

Since the volume of an alarm sound may be reduced, the life of a battery cell is increased. The timer alarm device is small-sized and light-weight so that it is convenient to be carried even when it is not used, and further that there is no inconvenience even if it is always actively mounted on an ear like an earring provided its design quality is improved.

When the present timer alarm device is mounted on an ear holding an earlobe therebetween as in case of an earring, a sense of incompatibility is reduced, and irritation with sweat and pain with pressing are eliminated even when it is mounted over a long period of time. A mounting mechanism is miniatutized and hence the mechanism is also miniaturized which serves to bring the output part of an audio sound to the vicinity of an ear hole, compared with the cases of bows of glasses and a hearing-aid where they are mounted on ears and disposed between the ears and the head.

Since the output part of an audio sound can be disposed at a distance from an ear hole, there is no possibility of the ear hole becoming stuffy internally and is no possibility of preventing a user from hearing surrounding sounds, compared with the case where the output part of an audio sound is inserted into the ear hole in a closed state.

The mounting mechanism in the present timer alarm device includes an arm member fixed to said casing structure and a clip member supported on the arm member, a concha being held between the arm member and said clip member in its thickness direction. The mounting mechanism further includes an arrangement where said casing structure is protruded to an ear side from said arm member, the arrangement being adapted such that said casing structure is caught by the edge of a circumferential recess of the ear hole when the wall of the concha is held between said arm member and said clip member.

The arm member and the rotatable clip member are biased in the direction of holding the ear with a spring structure, etc., and the present timer alarm device is attached to the ear by holding the concha (including the earlobe) between the arm member and the clip member in the thickness direction of the concha. The arm member is extended from the edge side of the ear to the center side of the same, and the casing structure fixed to the end of the arm member is located in the vicinity of the ear hole.

The present timer alarm device is mountable on an ear with the reduced number of parts, and the length of each individual parts is small-sized without exceeding the width of the concha so that the whole of the device is miniaturized and light-weighted and further a feeling of physical disorder and pain when the device is attached to the ear are reduced.

The arm member, the clip member, and the casing structure restrict the cross section of an ear in three directions by hitching the casing structure in a one step recess extending around the ear hole by making use of the feature of the configuration of the concha including the recess, so that even if pinching force of holding the concha between the arm member and the clip member in the thickness direction of the concha is smaller the whole of the device is securely supported on the ear.

Accordingly, there is eliminated the possibility of the device slipping off the ear owing to sweat, and there is reduced the possibility of the device slipping out the ear even if it undergoes strong shock or contact.

The timer circuit includes an input circuit that has two switches which are different from each other in ticking time intervals of set time and that sets the sum total of products of the number of times of operation of each said switch and the ticking time intervals.

The two switches having different ticking time intervals such as 1 minute and 1 hour, 10 minutes and 1 hour, and so on are operated, and the set time of the timer function is set as the sum total of the ticking time interval×the number of times of the operations of each switch. The switch having the larger ticking time intervals saves the total number of times of operations while the other switch having the smaller ticking time intervals improves fineness (resolution) of the set time. The switches may be three or more that have different ticking time intervals respectively.

Since the set time is set with the number of times of operations of two or more switches each having different ticking time intervals, there is ensured a device that includes no dial and display and that is small-sized and light-weighted and further enjoys power saving. There is further ensured time setting that does not rely on a user's eye and there can be executed accurate time setting with the less number of times of operations.

The timer circuit includes a setting standby circuit that brings the device into a standby state by detecting the two switches being simultaneously operated to reset time counting and hence wait next operation of the time setting.

The switch for time setting of the timer function is shared for reset/standby operation, whereby an exclusive reset switch and standby switch are made unnecessary. Once the two switches are simultaneously operated, the timer function is reset and simultaneously the operation is brought into a standby state of the setting operation, whereby the next time counting of the timer function can be always started waiting new time setting.

The function is utilized when a mistake is made in the time setting and when it is desired to alter the setting time during the time counting. Further, measures and correction are ensured as a user desires also when the user becomes aware of a mistake just before a lapse of the set time and an alarm is desirous of cancellation.

The timer circuit can include a timer starting circuit which detects that the time setting operation stops for a predetermined time to automatically start the time counting. The timer starting circuit determines that the setting operation has been completed when the operation of the time setting of the timer function stops for several seconds or more, and automatically starts the time counting of the timer function which takes the set time as a target, so that there is no need of providing an exclusive start switch. The number of parts is reduced and the device is small-sized and light-weighted. The reduction of the number of parts increases flexibility of the design of an external appearance and also facilitates waterproofing around the switches. Further, a user is not required for the particular counting start operation after the operation of the time setting.

Since the completion of the time setting operation is detected to automatically start the time counting, the device does not fail alarming by forgetting the start operation of the time counting after the time setting.

The timer circuit can connect setting details informing circuit which detects that the time setting operation stops for a predetermined time and informs a user of set time which is set up to that time with use of an audio sound once or more times.

Since the setting details informing circuit determines that the setting operation has been completed as soon as the operation of the time setting of the timer function stops for several seconds or more and informs a user of the length of the set time with use of an audio sound, there is eliminated the need of a dial or a figure display for visual confirmation of the set time, and hence the device is small-sized and the life of a battery cell is prolonged.

A user can hear details set by himself with an ear and confirm whether or not the time setting that has already been completed is executed without fail. The time counting is started with the set time that has been confirmed.

Since the completion of the operation of the time setting of the timer function is detected and automatically starts the time counting, it can be confirmed with an ear that transfer from the setting operation to the time counting has been normally completed. The setting details informing circuit includes a piezoelectric buzzer and indicates the set time with the number of intermittent sounds from the piezoelectric buzzer.

The setting details informing circuit shares the piezoelectric buzzer used for generating an alarm to indicate the set time so that it does not require an exclusive audio sound output device. The present timer alarm device is thus miniaturized and light-weighted to achieve a simplified circuit construction which shares also the driving circuit for the piezoelectric buzzer. This setting details informing circuit can be reasonably used even by foreigners who can not understand Japanese and persons who are not good at mental arithmetic.

When a plurality of kinds of intermittent sounds are used, a user hears out the kinds of intermittent sounds to count the number of generation times of intermittent sounds for each kind. For example, 1 hour is expressed by one long generation sound and 5 minutes are expressed by one short generation sound.

When there are used a plurality of the switches which have different set ticking time intervals, the kind of a generation sound maybe set for each ticking time interval. The reason is that provided the number of operation times of each switch is coincident with the number of generation sounds of the corresponding kind, propriety of the setting can be confirmed even though further calculation is not done.

When integration time of smaller ticking time intervals is equal to a larger ticking time interval, the set time may be indicated with a generation sound corresponding to the larger ticking time interval to reduce the total number of generation sounds and hence facilitate the counting and the calculation.

The setting details informing circuit can be adapted such that two kinds of intermittent sounds are used in which at least one of the frequencies and time intervals thereof are different from each other corresponding to the two switches which have different ticking time intervals of the set time, and said intermittent sound of the one kind is outputted at an equal interval by the number of operation times of the one switch independently of the order of the operations of said two switches and in succession said intermittent sound of the other kind is outputted at an equal time interval by the number of operation times of the other switch to inform a user of the set time.

A user can know the set time by listening to intermittent sounds and discriminating the kind and number thereof with his ear. Further, even if a user operates the two switches randomly, the total number of operation times of each switch is indicated in order, so that even longer set time can be confirmed in a short time with less error.

When generation sounds corresponding to a larger ticking time interval are successively generated by a required number and thereafter generation sounds corresponding to a smaller ticking time interval are successively generated by a required number, conversion to time is esier than in the reverse order.

For the assembly of the present timer alarm device, the timer circuit for detecting the lapse of set time and the setting details informing circuit for performing indication of the set time with intermittent sounds using the piezoelectric buzzer are accomodated in an integrated circuit, and a circuit board including the integrated circuit and switch contacts, a plate-shaped battery cell, and a piezoelectric buzzer for outputting an alarm of an audio sound are superimposed and put between a pair of casing members, and further push buttons for setting the set time are disposed on said switch contacts penetrating the one of said casing members.

The number of parts is reduced and the internal structure of the present timer alarm device is also simplified so that both of the parts cost and the assembly cost are reduced for the device to be further miniaturized and light-weighted. Replacement of the battery cell and failure parts is also facilitated.

It is desirable for the present timer alarm device that it is concentrated into a construction required for a function of setting time and outputting an alarm, without mounting a display device for visually showing time and development of time counting or a lamp that turns on and off in shynchronism with the time counting, etc. It is further desired for the present timer alarm device that a plurality of the functions share push buttons and a piezoelectric buzzer to achieve starting and resetting of the timer function, cancellation of the time setting, indication of the set time, indication of the development of the time counting, and indication of continuation of the time counting, and so on.

The integrated circuit may be a microcomputer circuit including a memory, and functions expressed as the foregoing circuits including the timer circuit may be executed in time division following a predetermined processing program. The integrated circuit may be a logic circuit using multi-purposed gate array or a MOS logic circuit that is exclusively pattern designed, etc.

Operation of the timer function is done by pushing push buttons heads which appear on the back of the casing.

In accordance with the second aspect of the present invention, there are connected to the timer circuit an input circuit that includes only one switch in which there is performed time setting where predetermined ticking time intervals are accomodated for each one operation, and a setting standby circuit which detects that said switch is operated continuously over a predetermined time to reset the time counting operation and hereby bring about a standby state where the operation waits the next operation of the time setting. There are executed the setting of the set time and the reset/standby opeartion only with one switch. The time setting of 30 minutes for example is performed for each one operation of the switch, and hence the setting of 3 hours is executed by operating the switch successively 6 times in a short time. Further, the reset/standby operation is achieved by continuously operating the switch over a predetermined time.

Since only one switch is to be operated, the number of parts is further reduced compared with the case of two switches to further make the present timer alarm device miniaturized and light-weighted. This permits the switch to be large-sized for easy operation and hence increases flexibility of the design of the structure. Since there is no need to see the switch, there is no need of relying upon user's eye when the device is operated and hence the device is useable even in a complete unseen state.

Also in the second aspect, there are provided the timer starting circuit and the setting details informing circuit, etc., as in the first aspect.

In accordance with the third aspect of the present invention, it is applied also to applications other than the timer alarm device. More specifically, there are provided a casing structure accomodating a audio sound output unit and a pinch structure which can take a open position and closed position and which is fixed to said casing structure in a positional relationship and located at a distance from said casing structure, whereby said casing structure is protruded toward an ear hole side in the state where said pinch structure is closed to pinch a body of a concha in the thickness direction and the casing structure is caught by the edge of a recess around the ear hole.

The device is securely supported on an ear in corporation with the pinch structure and the protruded casing structure, so that the present device does not fall down from the ear even if it is exposed to a strong shock. Regardless of its being securely supported, there are reduced loads to the ear and the ear hole compared with conventional headphones and earphones, and air permeability is also satisfactorily secured, and further it does not prevent a user from hearing surrounding necessary voices and sound information such as notice of danger.

Further, since an audio sound is outputted near the earhole, user's attention can be securely called, and there is no possibility of leaving the device behind and of being uncapable of remembering a hiding place even if the user forgets that he carries the device.

A complete set of circuits for actuating the audio sound output device and a power supply therefor are preferably accomodated in said casing structure. Provided the power supply and a complete set of the circuits, both being required, are accomodated in the casing structure, the function of the device can be demonstrated without relying upon external power supply and signal supply through a cable. The present invention is applicable to clocks, gas alarms, various sensors, radios, transceivers, pocket bells, and calling devices, etc., additionally to the timer alarm device.

BRIEF DESCRIPTION OF THE DRAWINGS

The above and other objects, features and advantages of the present invention will beome more apparent from the following description when taken in conjunction with the accompanying drawings in which preferred embodiments of the present invention are shown by way of illustrative example.

DETAILED DESCRIPTION OF THE PREFERRED EMBODIMENTS

In what follows, a timer alarm device of an embodiment of the present invention will be described with reference to the accompanying drawings.

Figure 1:
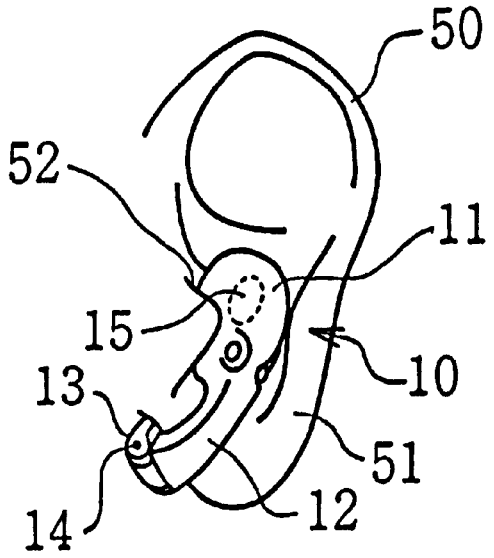
FIG. 1 is a view illustrating a state where a timer alarm device according to an embodiment of the present invention is attached to an ear.

As illustrated in FIG. 1, a timer alarm device 10 is supported on an ear 50 by pinching a thick part of a concha 51 between an arm 12 and a clip 13 coupled rotatably through a shaft 14. A head part 11 is disposed at the root of the arm 12 in which there are accomodated an electric circuit and a battery cell, etc. A casing structure of the head part 11, the arm 12, and the clip 13 is formed with a light-weight resin.

The timer alarm device 10 when attached to the ear 50 permits the head part 11 to be located in the vicinity of an ear hole 52 and a piezoelectric buzzer 15 to be held facing the earhole 52 for informing a user of the lapse of set time. Since the head part 11 does not completely close the earhole 52, the inside of the ear hole 52 does not get wet even if the device is attached over a long time and does not completely interrupt external sounds.

Figure 2:
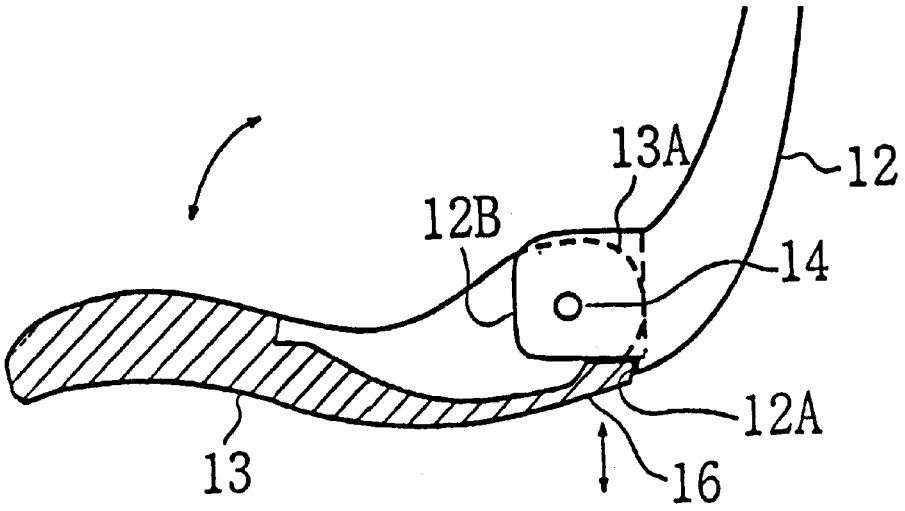
FIG. 2 is a view illustrating the state of a mechanism for pinching an ear in the thickness direction thereof being opened.

As illustrated in FIG. 2, the clip 13 includes a spring 16, which performs stopper function as well as spring function, between opposing shaft holding parts 13A supported on the arm 12 through the hinge shaft 14, and the spring 16 extends in a cantilevered fashion from the tip end side of the clip 13. When the clip 13 is opened to the arm 12 up to the angle of about 120 degrees the surface of the tip end of the spring 16 molded integrally with the clip 13 strikes a stepped part 12A of the arm 12 to prevent the clip 13 from being further opened.

Figure 3:
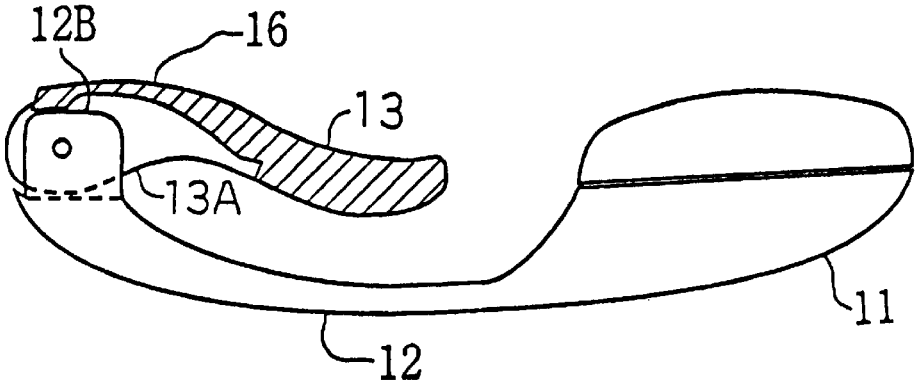
FIG. 3 is a partly broken side view illustrating the whole of the timer alarm device.

As illustrated in FIG. 3, in a pinch state where the clip 13 is closed toward the arm 12 a flat surface 12B of the arm 12 is pressed against the side surface of the spring 16 to keep an opposing distance between the clip 13 and the arm 12 smaller. Once a thick part of a concha 51 is pinched with the clip 13 and the arm 12, the end surface of the spring 16 gets on the corner of the flat part 12B to produce spring force and hence exert slight compression force on the thick part of the concha 51.

Further, a part of the head part 11 protruded frontally (upwardly in the figure) from the arm 12 engages with an uneven part of the concha 51 (the casing structure falls down in a recessed part around the ear hole 52.), and the concha 51 is restricted with the arm 12, the clip 13, and the head part 11 in four directions. Hereby, the timer alarm device 10 is securely held on the ear 50 even though the pinch force with the arm 12 and the clip 13 is small.

Since the opposing distance between the arm 12 and the clip 13 in the pinching state is set to be smaller than the average thickness of an earlobe, it is also possible to attach the timer alarm device to the ear by pinching the earlobe with the arm 12 and the clip 13 simply as in an earring, without falling down the head part 11 in the recessed part around the ear hole 12.

The position to attach the timer alarm device 10 on the concha 51 may not be a lower side part shown in FIG. 1. Positions to ensure an optimum attachment feeling and optimum alarming may be adopted taking the size of the timer alarm device 10 and individual differences of the shapes of the earlobes 51 into consideration, e.g., a side part and an upper side part of the concha 51 are pinched and the head 11 is fallen down in the recessed part around the ear hole 52.

Figure 4:
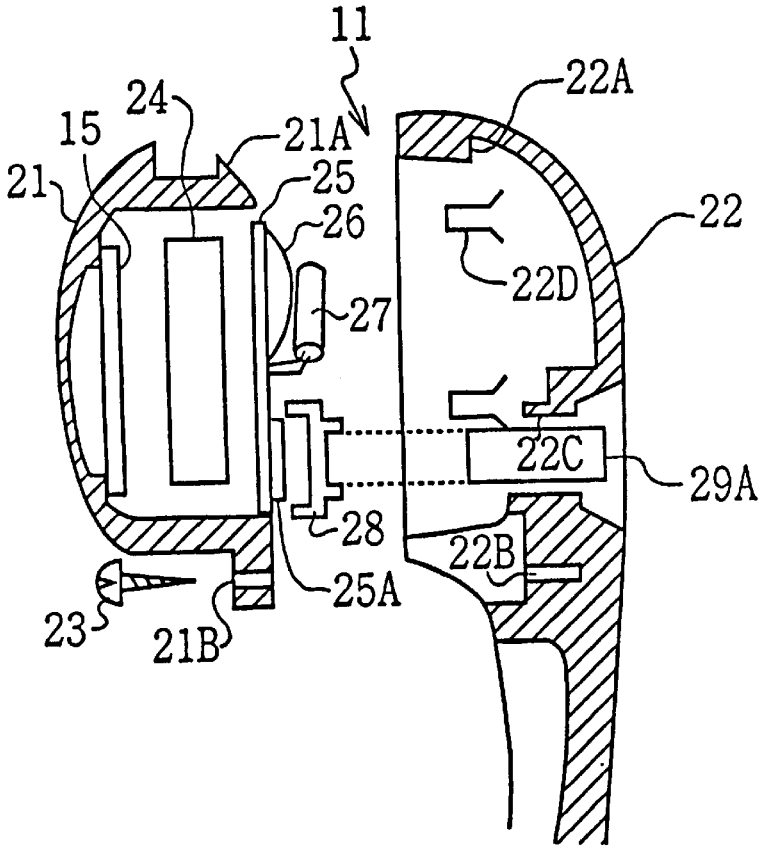
FIG. 4 is a view illustrating an internal structure shown with a decomposed state of a head.
Figure 6:
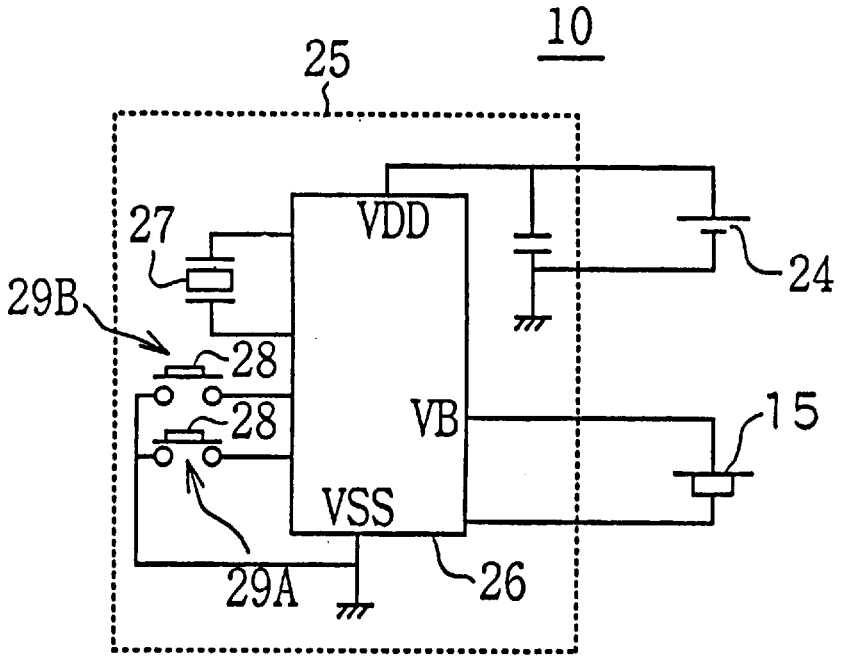
FIG. 6 is a circuit diagram of the timer alarm device.

As illustrated in FIG. 4, the head part 11 of the timer alarm device 10 is constructed such that the thin plate-shaped piezoelectric buzzer 15, a disk-shaped lithium battery cell 24, and a circuit board 25 are superimposed and accomodated in an internal space surrounded by the assembled cover 21 and casing 22. The piezoelectric buzzer 15, the battery cell 24, and the circuit board 25 are connected as shown in FIG. 6 with several wires (not shown). A resin protrusion 22D protruded from a casing 22 pushes the circuit board 25 and hence presses the piezoelectric buzzer 15 against the cover 21 to hereby pinch the battery cell 24 and the circuit board 25 for positioning thereof so as to prevent them from being moved.

The cover 21 is fixed to the casing 22 by forcing a hook part 21A to be caught by a shelf part 22A of the casing 22, and superimposing an opposite side hole 21B on a hole 22B in the casing 22, and further screwing a screw 23 therein.

Printed wiring including two comb-shaped electrodes 25A is formed on the opposite surface of the circuit board 25 facing to the battery cell 24, and several electronic parts including a resin molded integrated circuit 26 and a quartz oscillator 27 are mounted on the printed wiring. Conductive rubber electrodes 28 are disposed on the respective comb-shaped electrodes 25A, and push buttons 29A (29B) are mounted on the respective conductive rubber electrodes 28. The push button 29A(29B) is slidably held in two through-holes 22C.

Figure 5:
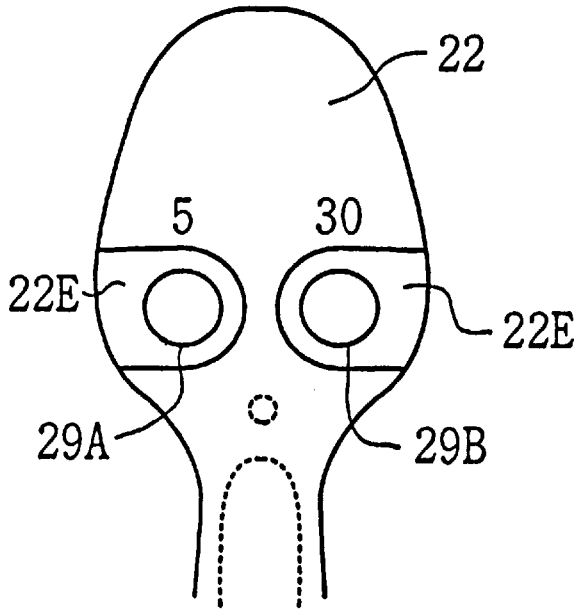
FIG. 5 is a view illustrating the arrangement of a switch on the back of the head.

As illustrated in FIG. 5, a pair of recessed portions 22E are formed in the back surface side of the casing 22, and heads of the two push buttons 29A, 29B are protruded within the limit of the amount of the recess of the recessed portions 22E. In setting operation of the set time, the protruded heads of the push buttons 29A, 29B are pushed in with a fingertip. Since the periphery of the recessed portion 22E rises like a wall, it is difficult that the push buttons 29A, 29B make contact with another matter and be pushed in within a pocket or a bag.

FIG. 6 is a circuit diagram of the timer alarm device 10. The integrated circuit 26 mounted on the circuit board 25 includes as a main part a MOS logic circuit constructed using an exclusive mask pattern. In the integrated circuit 26, there are included an input circuit, the timer circuit, a setting response circuit, a setting details informing circuit, a setting standby circuit, a timer starting circuit, a piezoelectric buzzer output circuit, and a power supply circuit, etc.

The input circuit is a counter circuit in a sense for counting the number of pushing of the push button 29A, 29B to set a particular time.

The timer circuit accumulates clock pulse signals formed from an output of the quartz oscillator, and actuates the piezoelectric buzzer 15 when an accumulation value coincides with the set time.

The setting response circuit uses two kinds of intermittent sounds when a user sets the time as described later, and actuates the piezoelectric buzzer 15 one at a time every time the push buttons 29A, 29B are depressed.

The setting details informing circuit determines that the setting operation was completed when 5 seconds elapsed after the push buttons 29A, 29B were finally depressed, and actuates the piezoelectric buzzer 15 by the number of times of the depression corresponding to the time finally set.

The setting standby circuit resets operation of the timer circuit and starts the input circuit when the push buttons 29A, 29B are continuously simultaneously depressed over 2 seconds, and brings the input circuit into a standby state where it waits starting of the time setting with the push buttons 29A, 29B.

The timer starting circuit forces the timer circuit start the time counting after 5 seconds since the operation of the piezoelectric buzzer 15 by the setting details informing circuit is completed. The piezoelectric buzzer output circuit defines the volume, frequency, and a repetition time interval, etc., of the piezoelectric buzzer 15 in response to the case where the piezoelectric buzzer 15 should be actuated, and outputs a power pulse signal for driving the piezoelectric buzzer 15.

The power supply circuit forms power supply voltage used for the integrated circuit 26 and the piezoelectric buzzer 15 from an output of the battery cell 24.

A reset/standby operation takes place when a user depresses both of the push buttons 29A, 29B continuously over 2 seconds, and the operation of the time setting through the push buttons 29A, 29B is enabled in the timer alarm device 10. In this state, 5 minutes are added to the set time each time the push button 29A is depressed one time, and 30 minutes are added thereto each time the push button 29B is depressed one time.

Set time from shortest 5 minutes to longest 10 hours is ensured for every 5 minutes in combination of the number of times of the depression of the push buttons 29A, 29B.

Figure 7:
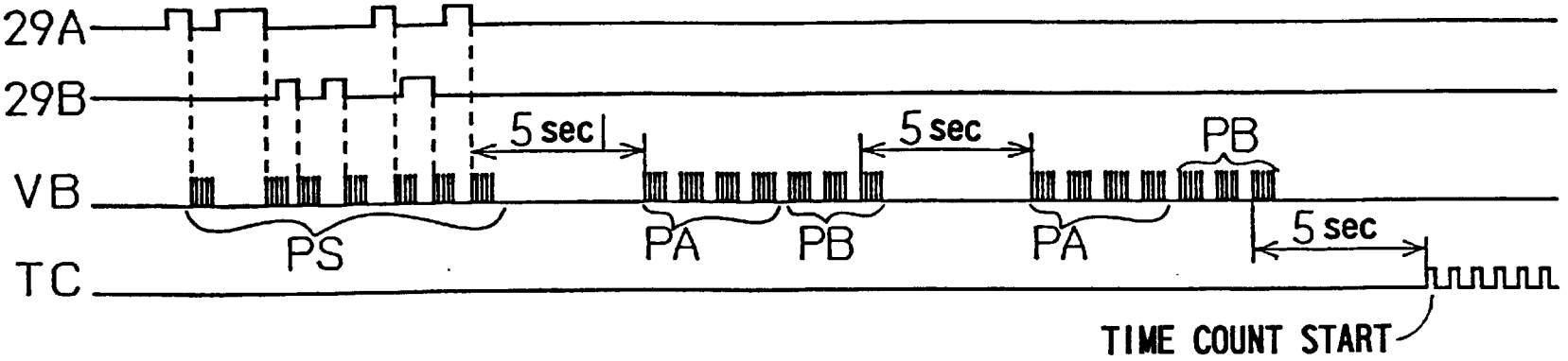
FIG. 7 is a timing chart of the timer alarm device.
Figure 7:
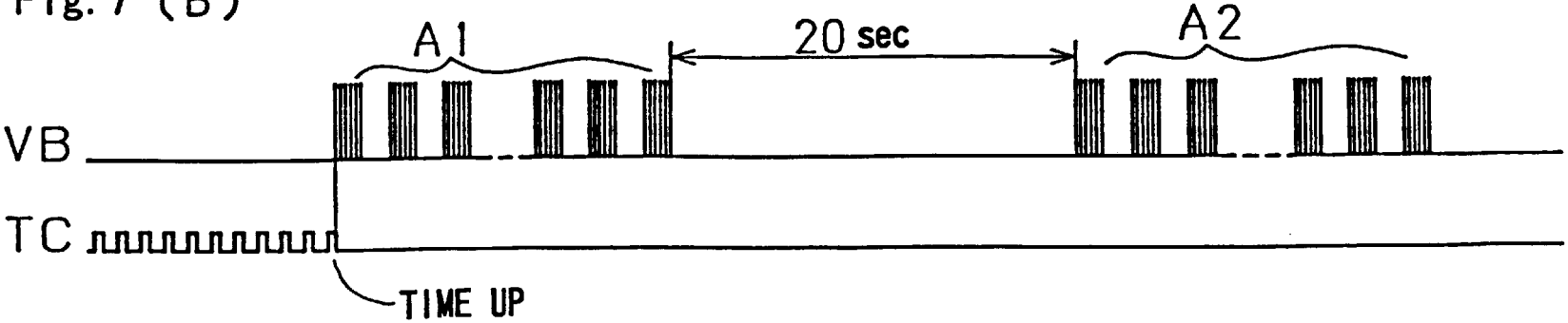

FIG. 7(*a*) is a timing chart for an example of the setting processing wherein there are shown an output VB to the piezoelectric buzzer 15 in the integrated circuit 26 and time counts TC together with the operation status of the push buttons 29A, 29B.

Every time a user depresses the push buttons 29A, 29B, a check sound PS is outputted for 50 ms from the piezoelectric buzzer 15. There are outputted a 640 Hz intermittent sound with the depression of the push button 29A and a 2048 Hz intermittent sound with the depression of the push button 29B. There are no limitation to the numbers of operation times and operation orders of the push buttons 29A, 29B, and setting of several hours may be executed only with 5 minute accumulation by the push button 29A.

Once the operation of the push buttons 29A, 29B are interrupted for 5 seconds, the integrated circuit 26 determines that the operation of the time setting has been completed, and indicates the set time intended to be counted with use of the numbers of the intermittent sounds PA, PB of the piezoelectric buzzer 15. First, a 2048 Hz 40 ms intermittent sound PA corresponding to 30 minutes is outputted by the number of depression times of the push button 29B, and in succession a 640 Hz 40 ms intermittent sound PB corresponding to 5 minutes is outputted by the number of depression times of the push button 29A. The periods of the intermittent sounds are 500 ms.

Accordingly, the user can judge whether the setting is correct or not without the need of complicated calculation by counting the number of the intermittent sounds of each kind outputted at the ear and only judging whether the number coincides with the memorized number of times by which the user pushes each of the push buttons 29A, 29B or not.

The indication of the set time with the intermittent sounds is repeated two times with a 5 second interval putted therebetween to deal with the possibility of user's failing to hear it or mis-hearing.

Once the second time indication of set time is completed and 5 seconds elapse, the integrated circuit 26 starts time counting. Thereafter, as accumulation time of the time counting reaches the set time, the integrated circuit 26 actuates the piezoelectric buzzer 15 to generate an alarm for information of the lapse of the set time to the user as illustrated in FIG. 7(*b*).

The alarm repeats 20 times the operation in which it outputs 2048 Hz 32 ms intermittent sounds 6 times 32 ms apart and rests for 125 ms. Notice should be herein taken of that FIG. 7(*b*) is partly neglected in order to shorten the length of the time axis. Alarms A1, A2 of 1 cycle generated in such a manner are outputted two times 20 seconds apart. The integrated circuit 26 automatically proceeds to a standby state after the second time alarm A2 is outputted whereby time setting is enabled anew at any time by operating the push buttons 29A, 29B.

The integrated circuit 26 is resettable at any time when wrong time is set by mistake, when the setting is desired to be tried again in the course of the time counting, or when the setting is desired to be cancelled. The resetting is achieved by simultaneously continuously depressing the push buttons 29A, 29B over 2 seconds. At this time, a 1024 Hz 2 second confirmation sound is outputted through the piezoelectric buzzer 15, and the integrated circuit 26 automatically proceeds to a standby state.

Once in this state the operation of the time setting is again executed, the set time is indicated through the piezoelectric buzzer 15 5 seconds after the completion of the setting operation, and thereafter the time counting is automatically started.

According to the timer alarm device 10 of the present embodiment, the concha 51 is restricted with the arm 12, the clip 13, and the head part 11 in four directions to reduce the pinching force by the arm 12 and the clip 13 so that there is eliminated the possibility of blood congestion in the ear 50 and any pains being produced during the attachment. Thus the device can be attached to an ear with a miniature light-weight structure like an earring without causing a feeling of physical disorder or any pain.

Further, since the head part 11 is positioned just close to the ear hole 52, user's attention can be securely called even when the sound volume of the piezoelectric buzzer 15 is small. Therefore, there is no possibility of defects, which are encounterred in a case of prior art alarm-equipped wristwatch, such as user's fail in hearing the alarm when the user thrusts his arm on which the wristwatch is attached into a thick bedquilt, when the user wears a full-faced helmet, or when a wristwatch is demounted owing to user's reasons.

Since there are limited components required for the function to detect the lapse of time of the set time for actuation of the piezoelectric buzzer 15 and there is completely eliminated the use of any construction for confirmation with an eye such as a liquid crystal device, the number of parts is reduced to bring the whole device into a miniaturized, light-weighted and simplified construction, and the relatively long life of the battery cell is also ensured. Hererby, the present device can be reasonably attached to and hung from an ear.

Further, since varieties of response sounds and confirmation sounds, and indication of the set time can be outputted using the piezoelectric buzzer 15, the timer alarm device 10 is useable with safety and reliability even without use of an indicator or lamp for confirmation of the operation and set details with an eye. Conversely speaking, operation relying on an eye is eliminated upon the time setting and the starting so that the present device is useable by persons having eye troubles and busy persons having no time to look at the indication.

Although in the present embodiment the 2048 Hz intermittent sounds PA corresponding to 30 minutes and the 640 Hz intermittent sounds PB corresponding to 5 minutes are outputted by the number of depression of the push buttons 29A, 29B at a time to indicate the set time, it will do to first output the 2048 Hz intermittent sounds corresponding to 30 minutes by m (=set time/30 minutes) and then outputting the 640 Hz intermittent sounds PB corresponding to 5 minutes by n (=(set time −30m)/5 minutes). In this case, a user can judge whether or not the setting is correct by hearing indication of the intermittent sounds outputted at the ear and calculating (30 m+5n) in mental arithmetic after operation to set time by depressing the push buttons 29A, 29B. Further, in this case, the indication may be executed with three kinds of intermittent sounds corresponding to 1 hour, 10 minutes, and 5 minutes.

The integrated circuit 26 may be a logic circuit which is formed by applying necessary short-circuitting and opening processing to a general-purpose gate array chip, or may be subjected to program operation as a 1 chip microcomputer circuit.

Although in the present embodiment the set time is indicated with sounds from the piezoelectric buzzer, two light emitting diodes may be provided on the back surface of the head part 11 adjoining to the switches 29A, 29B. In that case, provided the set number of 30 minutes is indicated with the number of times of on-and-off of light of one of the two light emitting diodes and that of 5 minutes is indicated with the number of times of on-and-off of light of the other, set details can be securely confirmed even under severe noise environment.

Further, it may be permitted to provide an independent light emitting diode on the back of the head part 11 and emit intermittent light (e.g., about 5 ms once for 10 seconds) in the course of the time counting. It can be confirmed that the operation is in the course of the time counting and hence useless care can be eliminated.

Although in the present embodiment the two switches 29A, 29B are provided, a construction may be used in which the entire external appearance and an attachment mechanism of the timer alarm device are left behind as they are and only one switch is disposed on the back of the head part.

Every time the one switch is depressed, 20 minutes are added to the set time, and once the switch operation is interrupted for 5 minutes, the set time is indicated with two kinds of intermittent sounds. First, 500 ms intermittent sounds corresponding to 1 hour are outputted by m (=set time/60 minutes), and then 50 ms intermittent sounds corresponding to 10 minutes are outputted by ((set time −60 m )/10). The reset/standby operation is achieved by continuously depressing the one switch over 2 seconds.

With such a construction only one switch may be operated so that there is no need of mutually discriminating the switch upon the use of the timer alarm device and there is no possibility of depressing a wrong switch by mistake. The reset/standby operation and the operation of the time setting may be allowed by groping for operation of the device keeping it attached to an ear.

Figure 8:
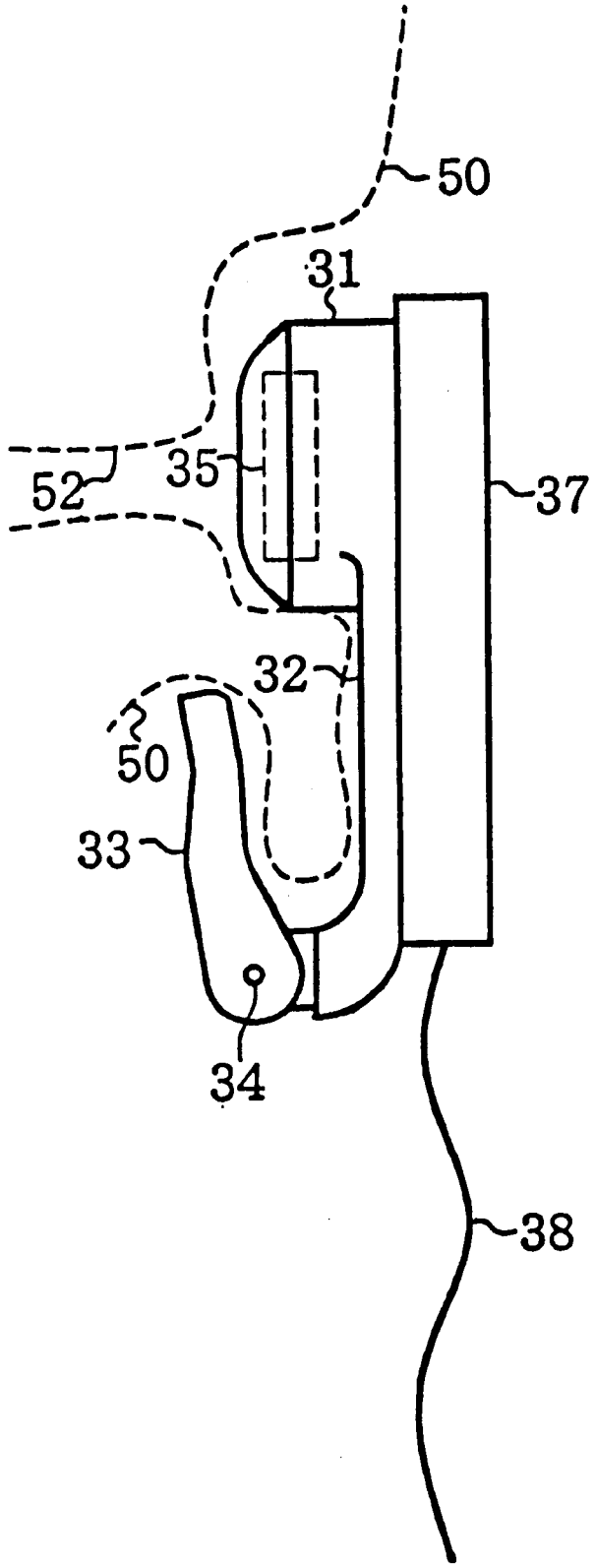
FIG. 8 is a view illustrating an external appearance structure of a calling device of the embodiment.

FIG. 8 is a view illustrating a calling device using an ear attachment structure as the second embodiment of the present invention.

As illustrated in FIG. 8, the calling device according to the present embodiment includes a receiver circuit provided in a circuit housing 37 disposed on a back surface side of the arm 32 for receiving a radio signal. The receiver circuit receives radio waves through an antenna 38 from the outside, and once it receives a radio signal with predetermined intensity or more in a specific frequency band drives a piezoelectric buzzer output circuit which is constructed like the timer alarm device of the former embodiment.

The receiver circuit and the piezoelectric buzzer output circuit are supplied with power from a lithium battery cell (not shown) housed in the head part 31. Once the piezoelectric buzzer 35 housed in the head part 31 outputs an alarm sound in the vicinity of the ear hole 52, attention of a user can be securely called.

The calling device is adapted such that the clip 33 is rotatably mounted on the end of the arm 32 through the hinge shaft 34 and has an external appearance structure where the head part 31 is protruded from the surface of the arm 32 to the same side of the clip 33. Accordingly, once the device is attached to an ear 50 pinching the thick part (concha) of the ear 50 between the arm 32 and the clip 33, the head part 31 that accomodates the piezoelectric buzzer 35 therein is caught by an edge of a recess around the ear hole 52.

At this time, the calling device is supported by a part of the ear 50 pinched between the arm 32 and the clip 33 so that greater flexibility of attitude of the device to the ear hole 52 is ensured, and loads to the ear hole 52 and the recess around the same are reduced, and the degree of interrupting external sounds is reduced, and further permeability to the ear hole 52 is also satisfactorily ensured.

The ear attachment structure of the present invention is attached to an ear such that the head part is caught by the recess around the ear hole in the state where the thick part of the ear is pinched with the arm and the clip, therefore, an output sound by a piezoelectric buzzer or a small-sized speaker is generated near the ear hole. Accordingly, the ear attachment structure is useable also to the following applications additionally to the timer alarm device and the calling device described above by altering the circuit and the function housed in the head part (casing structure):

(1) There are housed a detector circuit for detecting radiation or electromagnetic waves to generate an electric signal, a discriminator circuit for discriminating whether or not intensity of the generated electric signal exceeds a threshold, and a piezoelectric buzzer output circuit like the timer alarm device in the foregoing embodiment, etc., wherein an alarm is outputted from the piezoelectric buzzer once exposure beyond predetermined intensity is received.

(2) There are housed a sensor for detecting at least one among carbon monoxide, carbon dioxide, nitrogen oxide, propane gas, and dust to generate an electric signal, a discriminator circuit for discriminating whether or not intensity of the generated electric signal is exceeds a threshold, and a piezoelectric buzzer output circuit like the timer alarm device in the foregoing embodiment, etc., wherein an alarm is outputted from the piezoelectric buzzer once concentration of gas, etc., exceeds a safety standard.

(3) There is housed a small-sized speaker wherein a device is actuated with a voice signal supplied from the outside through a cable. There is realized an earphone securely supported although a load to an ear is reduced compared with conventional earphones in which they are fitted to a recess around an ear hole or they are inserted into the ear hole for fixation thereof.

(4) There are housed a receiver for a radio or a radio speaking device and a voice output circuit. An external radio wave signal is received, and a voice signal is extracted and music, broadcasting, and messages are outputted through a small-sized speaker.

(5) There is housed a receiver circuit of a conventional pocket bell. An external radio wave signal is received and a corresponding signal is extracted, and a calling sound is outputted in response to an extaraction result.

(6) There is housed at least one among a thermometer, a clock, an altimeter (a barometer). A liquid crystal display is provided on the back of the head of timer alarm device of the foregoing embodiment, whereby temperature, time, and altitude, etc., are displayed at all times as well as an alarm is outputted when any danger or sunset time is approached in mountain-climbing, etc.

What is claimed is:

1. A timer alarm device comprising:

an input circuit for setting an accumulated alarm time;

a timer circuit for detecting the lapse of the alarm time and generating an alarm driving signal;

alarm output means driven by said alarm driving signal for outputting an audio alarm sound;

a battery cell for supplying power to said timer circuit and said alarm output means; and a casing structure including a head part for accommodating said timer circuit, said alarm output means, and said battery cell therein;

wherein the volume of said casing structure and the weight of the whole timer alarm device is defined to fall within a range in which the whole timer alarm device is supportable on an ear;

wherein an attachment mechanism is coupled to head part of the casing structure to support said casing structure on the ear, without the attachment mechanism extending into an ear hole of the ear, and locates said alarm output means in close proximity to the ear hole; and wherein said casing structure is protruded to an ear side from said arm member and is caught by the edge of a recess around the ear hole upon pinching the concha between the arm member and the clip member in the thickness direction of the concha.

2. A timer alarm device as defined in claim 1, wherein said attachment mechanism includes an arm member having a first end fixed to and extending from said head part of said casing structure and a clip member coupled to a second end of the arm member by a hinge, and wherein a thick part of concha of the ear is pinched between the arm member and the clip member.

3. A timer alarm device as defined in claim 1, wherein said input circuit includes two switches that are different in incremental time intervals, and the alarm time is set in accordance with and accumulation of a sum total of products of the number of operation times of said two individual switches and their respective incremental time intervals.

4. A timer alarm device as defined in claim 3, further comprising:

a setting standby circuit which detects simultaneous operation of said two switches and resets the timer circuit to wait for entry of a new alarm time.

5. A timer alarm device as defined in claim 1, wherein said input circuit includes only one switch for setting the alarm time in predetermined incremental time intervals that are accumulated for each operation of the switch, and wherein a setting standby circuit is provided which detects said switch being continuously operated over a predetermined time and resets the timer circuit to a standby state.

6. A timer alarm device as defined in claim 1, wherein the timer circuit detects when the operation of the input circuit to set the alarm time is stopped for a predetermined time and automatically starts counting the lapse of the set alarm time.

7. A timer alarm device as defined in claim 1, further comprising:

a setting details information circuit that detects when the operation of the input circuit to set the alarm time is stopped for a predetermined time and informs a user of the set alarm time by generating an audio sound.

8. A timer alarm device as defined in claim 7, wherein said alarm output means includes a piezoelectric buzzer for outputting said audio alarm sound, and said setting details information circuit indicates the set alarm time by generating a number of intermittent audio sounds from said piezoelectric buzzer.

9. A timer alarm device comprising:

an input circuit for setting an accumulated alarm time;

a timer circuit for detecting the lapse of the alarm time and generating an alarm driven signal;

alarm output means driven by said alarm driving signal for outputting an audio alarm sound;

a batter cell for supplying power to said timer circuit an said alarm output means; and a casing structure including a head part for accommodating said timer circuit, said alarm output means, and said battery cell therein;

wherein the volume of said casing structure and the weight of the whole timer alarm device is defined to fall within a range in which the whole timer alarm device is supportable on an ear;

wherein an attachment mechanism is coupled to head part of the casing structure to support said casing structure on the ear, without the attachment mechanism extending into an ear hole of the ear, and locates said alarm output means in close proximity to the ear hole; and wherein said input circuit includes two switches which are different in incremental time intervals;

wherein the alarm time is set in accordance with a sum total of products of the number of operation times of said two individual switches and their respective incremental time intervals;

wherein said setting details information circuit uses two kinds of intermittent audio sounds, which are different in at least one of frequency and length, that respectively correspond to said two switches; and wherein one kind of intermittent audio sound is generated based on the number of times of operation its corresponding switch and the second kind of intermittent audio sound is generated based on the number of times of operation of its corresponding switch.

10. A timer alarm device comprising:

an input circuit including at least two switches for setting an accumulated alarm time;

a timer circuit for detecting the lapse of the alarm time and generating an alarm driving signal;

alarm output means driven by said alarm driving signal for outputting an audio alarm sound;

a battery cell for supplying power to said timer circuit and said alarm output means; and a casing structure including a head part for accommodating said timer circuit, said alarm output means, and said battery cell therein;

wherein the volume of said casing structure and the weight of the whole timer alarm device is defined to fail within a range in which the whole timer alarm device is supportable on an ear;

wherein an attachment mechanism is coupled to head part of the casing structure to support said casing structure on the ear, without the attachment mechanism extending into an ear hole of the ear, and locates said alarm output means in close proximity to the ear hole;

wherein said alarm output means includes a piezoelectric buzzer for outputting said audio alarm sound, and said setting details information circuit indicates the set alarm time by generating number of intermittent audio sounds from said piezoelectric buzzer;

wherein said timer circuit for detecting the lapse of the set alarm time and said setting details information circuit for indicating the set alarm time with the intermittent audio sounds using said piezoelectric buzzer are provided in an integrated circuit device;

wherein a circuit board having a switch contact and supporting said integrated circuit, a plate-shaped battery cell and the piezoelectric buzzer for outputting the audio alarm sound are superimposed and sandwiched with a pair of casing members; and wherein at least one of said two switches includes a push button disposed on said switch contact and penetrating one of said casing members.

11. An apparatus comprising:

a casing structure including an audio sound output device located in a head part of the casing structure; and an attachment mechanism coupled to the head part of the casing structure to support said casing structure on the ear without either the casing structure and the attachment mechanism entering substantially into an ear hole of the ear, said attachment mechanism comprising an arm member including a first end extending from said head part of said casing structure and a clip member coupled to a second end of the arm member by hinge;

wherein said clip member has an open state in which said attachment mechanism is not attached to the ear and a closed state in which a thick part of concha of the ear is pinched between the arm member and the clip member; and wherein said attachment mechanism positions said head part of said casing structure at the ear hole such that said casing structure is caught by an edge of a recess around the ear hole when said clip member is in the closed state.

12. An apparatus as claimed in claim 11, wherein said audio sound output device comprises:

an input circuit for setting an accumulated alarm time;

a timer circuit for detecting the lapse of the alarm time and generating an alarm driving signal;

alarm output means driven by said alarm driving signal for outputting an audio alarm sound; and a battery cell for supplying power to said timer circuit and said alarm output means.

13. An apparatus as claimed in claim 12, wherein said input circuit includes two switches that are different in incremental time intervals, and the alarm time is set in accordance with and accumulation of a sum total of products of the number of operation times of said two individual switches and their respective incremental time intervals.

14. An apparatus as claimed in claim 13, further comprising:

a setting standby circuit which detects simultaneous operation of said two switches and resets the timer circuit to wait for entry of a new alarm time.

15. An apparatus as claimed in claim 13, wherein the timer circuit detects when the operation of the input circuit to set the alarm time is stopped for a predetermined time and automatically starts counting the lapse of the set alarm time.

16. An apparatus as claimed in claim 13 further comprising:

a setting details information circuit that detects when the operation of the input circuit to set the alarm time is stopped for a predetermined time and informs a user of the set alarm time by generating an audio sound.

17. An apparatus as claimed in claim 16, wherein said setting details information circuit uses two kinds of intermittent audio sounds, which are different in at least one of frequency and length, that respectively correspond to said two switches; and wherein one kind of intermittent audio sound is generated based on the number of times of operation of its corresponding switch and the second kind of intermittent audio sound is generated based on the number of times of operation of its corresponding switch.

* * * * *

UNITED STATES PATENT AND TRADEMARK OFFICE

CERTIFICATE OF CORRECTION

PATENT NO : 6,008,720

DATED : December 28, 1999

INVENTOR(S): Kanji HONGU et al.

It is certified that error appears in the above-identified patent and that said Letters Patent is hereby corrected as shown below:

Title page, item [73]

Please add --RIC COMPANY LTD., JAPAN--.

Signed and Sealed this

Twelfth Day of September, 2000

*Attest:*

Q. TODD DICKINSON

*Attesting Officer*

*Director of Patents and Trademarks*